US009597789B2

(12) United States Patent
Yoosefi

(10) Patent No.: US 9,597,789 B2
(45) Date of Patent: Mar. 21, 2017

(54) FLEXIBLE TOOL HOLDER

(71) Applicant: Christopher Yoosefi, Van Nuys, CA (US)

(72) Inventor: Christopher Yoosefi, Van Nuys, CA (US)

( * ) Notice: Subject to any disclaimer, the term of this patent is extended or adjusted under 35 U.S.C. 154(b) by 0 days.

(21) Appl. No.: 14/612,011

(22) Filed: Feb. 2, 2015

(65) Prior Publication Data

US 2015/0217441 A1 Aug. 6, 2015

Related U.S. Application Data

(60) Provisional application No. 61/934,437, filed on Jan. 31, 2014.

(51) Int. Cl.

| | |
|---|---|
| ***B65D 85/28*** | (2006.01) |
| ***B25H 3/00*** | (2006.01) |
| ***B65D 75/02*** | (2006.01) |
| ***B65D 75/52*** | (2006.01) |

(52) U.S. Cl.

CPC ..... *B25H 3/00* (2013.01); *B65D 75/02* (2013.01); *B65D 75/52* (2013.01)

(58) Field of Classification Search

CPC ..... B65D 75/02; B65D 75/52; B25H 3/00

USPC ..... 206/372, 373, 376–378; 190/109, 119, 190/125, 127; 383/38–40

See application file for complete search history.

(56) References Cited

U.S. PATENT DOCUMENTS

| | | | | |
|---|---|---|---|---|
| 1,085,950 | A * | 2/1914 | Steinthal | A45C 9/00 190/16 |
| 4,337,860 | A | 7/1982 | Carrigan et al. | |
| 4,738,547 | A * | 4/1988 | Brown | A45C 7/0095 383/39 |
| 4,865,194 | A | 9/1989 | Decarie et al. | |
| 4,901,899 | A * | 2/1990 | Barrett | A01K 97/06 383/39 |
| 4,949,843 | A * | 8/1990 | Stokes | A45C 7/0095 383/38 |
| 5,154,544 | A | 10/1992 | Arendt et al. | |
| 5,174,447 | A * | 12/1992 | Fleming | B25H 3/00 206/373 |
| 5,228,570 | A | 7/1993 | Robinson et al. | |
| 5,427,239 | A * | 6/1995 | Hunt | B25H 3/00 190/125 |
| 5,984,092 | A * | 11/1999 | Heard-Willmon | A45C 13/02 206/232 |
| 6,267,277 | B1 * | 7/2001 | Taylor | A45C 7/0095 206/373 |
| 6,991,105 | B2 | 1/2006 | Winnard et al. | |
| 7,510,092 | B2 | 3/2009 | Sholem et al. | |
| 2005/0232519 | A1 * | 10/2005 | Grimes | D06F 95/006 383/39 |

* cited by examiner

*Primary Examiner* — Luan K Bui
(74) *Attorney, Agent, or Firm* — KPPB LLP

(57) ABSTRACT

A flexible tool holder is provided. The tool holder is formed of a length of flexible material configured into discrete sections along which are positioned pockets and straps for securing tools associated with a specific tool, such as a socket wrench, including, for example, socket wrench handles, interchangeable sockets, socket adapters, etc. The flexible material and the discrete sections are configured such that the tool holder may be expanded and compacted by folding the flexible material in predetermined configurations.

19 Claims, 7 Drawing Sheets

FLEXIBLE TOOL HOLDER

CROSS-REFERENCE TO RELATED APPLICATIONS

The present application claims priority to U.S. Provisional Patent Application No. 61/934,437, filed Jan. 31, 2014, the disclosure of which is incorporated herein by reference.

FIELD OF THE INVENTION

The present invention generally relates to a flexible tool holder; and more particularly to a flexible tool holder configured to contain sockets, socket wrenches and socket wrench accessories, such as, for example, extensions and adapters.

BACKGROUND

Socket wrenches are tools widely used in a variety of mechanical applications. Unique among wrenches, the socket wrench comprises a single handle portion with a head at one end that can be interconnected with interchangeable sockets designed to engage fasteners, such as bolts, screws, etc. of various sizes. The head of the socket wrench handle typically includes a ratchet mechanism, but may also include swivel or hinge mechanisms. Regardless of the design of the handle, or the mechanism of its action, the true utility of a socket wrench comes from the numerous interchangeable sockets that can be used with it. Even a relatively simple socket wrench set may contain a dozen or more sockets, and mechanics that rely on socket wrenches for applications in which a wide variety of bolt sizes are used, such as, for example, automotive applications, may need to use many dozens of sockets of various sizes.

Because the utility of a socket wrench depends on having sockets of various sizes, a challenge arises as to how to store, transport and organize these sockets. Many different devices have been proposed to address this challenge, including, tool boxes with divided compartments for each socket, racks (either mobile or fixable to a tool bench or wall) with a number of attachment points cooperative with sockets for holding them, and even socket handles that themselves have compartments or holding mechanisms. The holding mechanisms used have included spring-loaded devices, nubs that mimic the engagement portion of the socket wrench handle, magnetic attachment means, wires, etc.

Despite the variety of designs, most of these socket holders represent a trade-off between security, convenience and size. While racks that mechanically attach the sockets to a body provide excellent security, they are typically rigid and bulky and difficult to transport. Toolboxes with individual compartments are again typically bulky and rigid, but additionally often do not secure the individual sockets against movement during transport. Finally, while socket wrenches that incorporate a storage mechanism are convenient, they do not allow for the storage of a large number of sockets simultaneously. Accordingly, a need exists for an improved tool holder.

SUMMARY OF THE INVENTION

An apparatus in accordance with embodiments of the invention implement a flexible tool holder. In embodiments, the tool holder is formed of a length of flexible material onto discrete sections of which are positioned pockets and straps for securing tools associated with a tool such as a socket wrench, including, for example, socket wrench handles, interchangeable sockets, socket adapters, etc. The flexible material and the discrete sections are configured such that the tool holder may be expanded and compacted by folding the flexible material in particular configurations.

Some embodiments of the flexible tool holder include:

- a flexible body having inner and outer surfaces and defining at least a first rigid axis and at least a second compacting axis;
- a plurality of tool holders disposed on the inner surface of the flexible body, the plurality of tool holders being arranged within at least two discrete sections along the first rigid axis, each of the at least two discrete sections being separated by at least one flexible section therebetween having no tool holders disposed thereon; and
- wherein the tool holder is foldable along the second compacting axis in a predetermined compact configuration determined by the disposition of the at least two discrete sections of tool.

In other embodiments the tool holder includes at least three discrete sections of a plurality of tool holders each having at least one section of flexible material disposed therebetween.

In still other embodiments each of the discrete sections is defined by a separate section of semi-rigid material disposed between the inner and outer surfaces of the flexible body, each of the sections of semi-rigid material being arranged to resist folding of the flexible body along the first rigid axis along which the respective discrete section is disposed.

In yet other embodiments the semi-rigid material is formed of a resilient plastic material.

In still yet other embodiments the discrete sections and flexible sections are arranged such that the tool holder is compacted by folding adjacent discrete sections atop each other along the second compacting axis.

In still yet other embodiments the flexible tool holder further includes at least one strap disposed on the outer surface of the flexible body and arranged to releasable secure the tool holder in the predetermined compact configuration.

In still yet other embodiments the flexible tool holder further includes at least one carrying handle disposed on the outer surface of the flexible body.

In still yet other embodiments the plurality of tool holders are selected to secure tools selected from the group consisting of interchangeable sockets, socket wrenches, socket adapters, and ratchet tools.

In still yet other embodiments the flexible body is formed from a flexible material selected from the group consisting of woven fabrics, polymers, and plastics.

In still yet other embodiments the flexible tool holder further includes a backing material disposed between the inner and outer surfaces of the flexible body, the backing material selected from the group consisting of woven materials, plastics, rubbers, padding and bunting.

In still yet other embodiments the plurality of tool holders include at least one interchangeable socket holder strap having first and second ends secured to the inner surface of the flexible body and forming a loop having first and second loop openings disposed in-line and opposite each other both loop openings dimensioned to accept one interchangeable socket therebetween, wherein the first of the two open loop openings further comprises a securing portion disposed along at least a portion of the lateral edge thereof and configured to allow the interchangeable socket to enter said first loop opening and move proximal to said second loop opening, but prevent the interchangeable socket when disposed within the interchangeable socket holder strap from exiting said first loop opening. In some such embodiments the securing portion includes a strip of material having first and second strip edges and being disposed along at least a portion of the circumference of the first loop opening, wherein the first strip edge is disposed proximal the lateral edge of the first loop opening and securely attached to said interchangeable socket strap, and wherein the second strip edge is disposed within the loop distal the first loop opening, and wherein the second strip edge is unattached to the socket holder strap such that a movable flap of material is formed between the second and a first strip edges. In other such embodiments the strip of material is further securely attached to the interchangeable socket strap along a line between said first and second strip edges. In still other such embodiments the securing portion is dimensioned to partially occlude the first loop opening when the unattached second strip edge is urged proximal the first loop opening. In yet other such embodiments the at least one of either the interchangeable socket holder strap and the securing portion are formed of a resilient material.

In still yet other embodiments the plurality of tool holders are spaced apart from the edges of the flexible body such that a section of material having no tool holders is disposed around the outer perimeter of the inner surface of the flexible body.

In still yet other embodiments the flexible tool holder further includes tool fasteners deposed adjacent at least one of the plurality of tool holder and configured to securely restrain a tool within the at least one tool holder.

In still yet other embodiments the discrete and flexible sections are arranged such that the tool holder has multiple compacting axes.

In still yet other embodiments the tool holders are cooperatively arranged such that when the tool holder is compacted into predetermined compact configuration at least a portion of the tool holders of adjacent discrete sections are nonoverlapping.

In still yet other embodiments the flexible tool holder further includes tool labels disposed adjacent at least a portion of the tool holders and indicating at least the size of tool to be disposed therein.

Additional embodiments and features are set forth in part in the description that follows, and in part will become apparent to those skilled in the art upon examination of the specification or may be learned by the practice of the invention. A further understanding of the nature and advantages of the present invention may be realized by reference to the remaining portions of the specification and the drawings, which forms a part of this disclosure.

BRIEF DESCRIPTION OF THE DRAWINGS

The description will be more fully understood with reference to the following figures, which are presented as exemplary embodiments of the invention and should not be construed as a complete recitation of the scope of the invention, wherein.

DETAILED DESCRIPTION

Turning now to the drawings, a flexible tool holder is illustrated. In embodiments, the tool holder is formed of a length of flexible material onto discrete sections of which are positioned loops, pockets and straps for securing tools associated with a particular tool, such as, for example, a socket wrench, including, for example, socket wrench handles, interchangeable sockets, socket adapters, socket extenders, etc. The flexible material and the discrete sections are configured such that the tool holder may be expanded and compacted by folding the flexible material into a predetermined configuration, such as a roll, thereby securing and protecting the tools within the holder.

Figure 1:
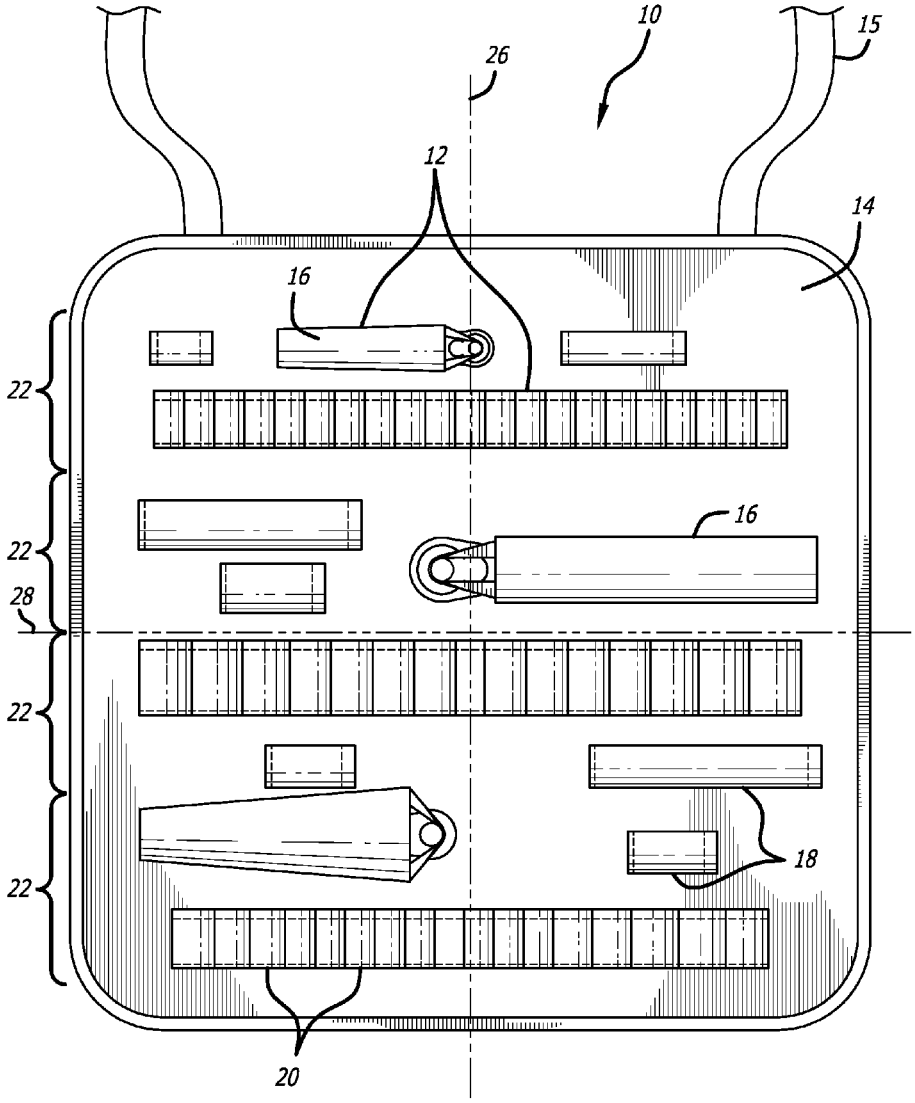
FIG. 1 illustrates a perspective view of a tool holder in an unrolled state in accordance with embodiments of the invention.

FIG. 1 provides a first view of an embodiment of a flexible tool holder (10). As shown, the holder includes a plurality of tool holding portions (12) disposed on an inner face of a length of flexible material (14). The tool holding portions are configured to hold specific pieces of a set of tool, such as, for example, a socket wrench set, including, for example, socket wrench handles (16), socket adapters (18) and interchangeable sockets (20) of various sizes, including deep and oversized sockets. As shown, the tool holding portions may be formed of loops of material, pockets, straps and other fasteners as are appropriate for the specific tool type. The flexible tool holder may also include straps (15) for securing the tool holder in a rolled or compacted shape and a carrying handle (not shown) along with other outer accessories including pockets, identification tags, etc.

Although the tool holding portions (12) may be disposed anywhere on the length of flexible material (14), in many embodiments the tool holding portions (12) are grouped in approximately equivalent tool holding sections (22) arranged generally along at least one rigid axis (28) with strips of flexible material separating these sections. The reason such an arrangement is advantageous is that though the flexible material substrate onto which the tool holding portions are disposed is equally flexible along its length, the tool holding portions inherently create areas of rigidity that resist folding. This rigidity becomes even more pronounced once the actual tools are inserted into the tool holding portions (12). By disposing the tool holding portions in groups or sections (22), and separating them with sections of unconstrained flexible material, it is possible to configure the tool holder so that it may be controllably folded into a predetermined compact configuration when rolled along a compacting axis (26). In many embodiments the individual tools and sections are arranged such that the tools within the sections fold together in a cooperative manner. For example, in one embodiment, as shown in FIG. 1, the ratchet head is positioned to fit between the interchangeable sockets in the space provided to provide an even compacted or rolled form. In some such embodiments the discrete sections cooperatively fold together such that the tool holding portions overlap or are non-overlapping such that the tool holding portions are enclosed and/or surrounded by other tool holding portions to provide additional security once engaged in its predetermined compact configurations.

Although the tool holding portions (12) shown in FIG. 1 are comprised of fixed straps and loops, in some embodiments the tool holders may comprise a single continuous resilient strap woven into and out of the flexible body (14). In such embodiments the strap may be adjusted to firmly secure the enclosed tools by tightening the strap around the tools once the tools are in position. Such an adjustable strap could be incorporated into the embodiments and arranged as otherwise described herein, but because of the adjustability of each individual tool holding portion, provide additional flexibility as to the placement of specific tools within the tool holder (10).

Figure 2A:
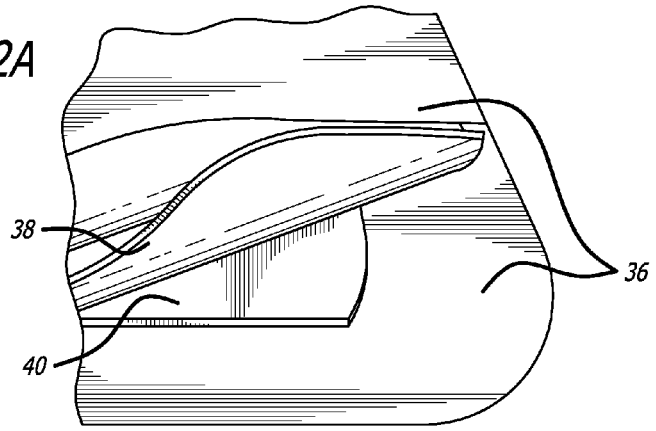
FIG. 2A illustrates a cross-section of the construction of a tool holder in accordance with embodiments of the invention.
Figure 2B:
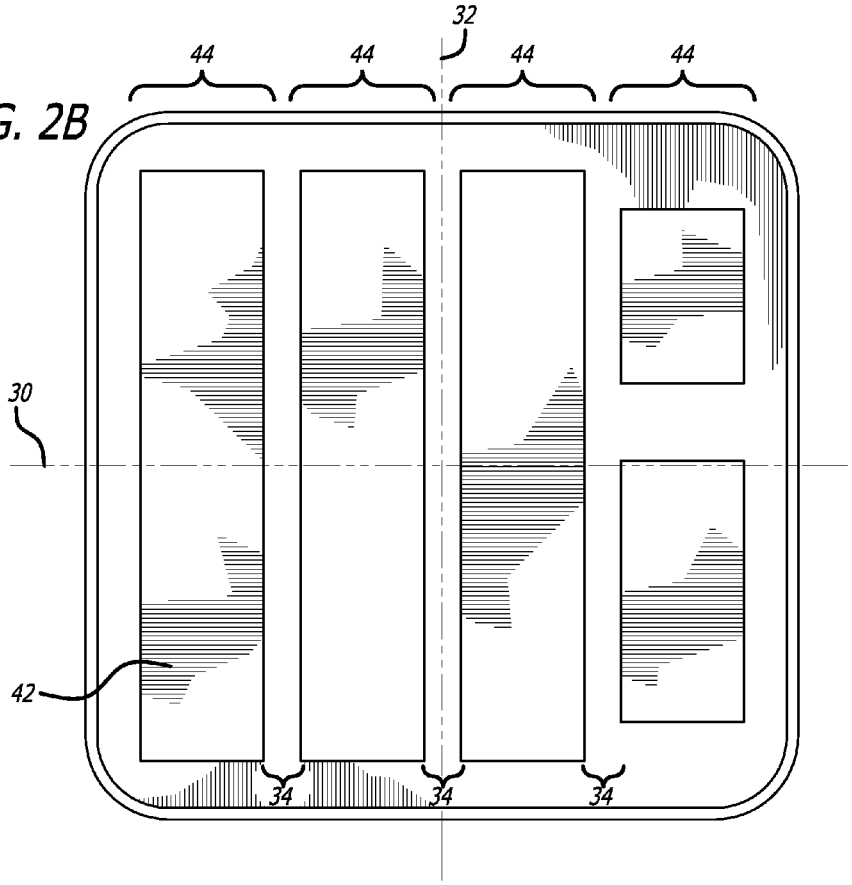
FIG. 2B illustrates a perspective view of the inner construction of a tool holder in accordance with embodiments of the invention.

The construction of embodiments of a controllably foldable tool holder are shown in FIGS. 2A and 2B. As shown, in such embodiments the tool holder may be fundamentally defined by at least one compacting axis (30) and at least one rigid axis (32). The tool holding portions are arranged in sections, groups or rows (44) along the rigid axis (32) with foldable strips or sections (34) of an unconstrained flexible material disposed there-between. In such a configuration it is possible to compact the tool holder by folding each of the sections, groups or rows of the tool holder along the foldable strips or sections (44) in a predetermined configuration, such that the tool holder may only be compacted in the direction of the compacting axis (30).

In many such embodiments, the flexible tool holder may be made of any number of layers of suitable flexible materials, capable of being folded or rolled into a compact form along the compacting axis (30). For example, in embodiments the flexible material can be formed from a single material or, as shown in FIG. 2A, multiple layers of materials including outer layers (36) and inner layers (38) and (40). Suitable materials for the outer layers (36) can include one or a combination of tough damage resistant fabrics and materials such as for example, woven fabrics, polymers, plastics, etc. Inner layers may include a thick flexible backing materials (38), such as, for example, woven materials, plastics, rubbers, padding, bunting, etc. that may serve as a backing or padding to protect the tools from impact damage or to provide additional support for the stitching of the tool holders. In many embodiments a semi-rigid, resilient inner material layer (40) may also be disposed within the flexible material. In such embodiments, this semi-rigid, resilient inner material (40) may be disposed and configured in strips or sections (42), as shown in FIG. 2B, to at least coincide with the folding portions (44) of the tool holder where the tool holding portions are positioned along the rigid axis (32). In these embodiments, the semi-rigid, resilient inner material may serve as a further rigid backing to which the tool holding portions can be securely fastened, and also serve to prevent the hard edges of the tools from wearing through the flexible material of the tool holder. The semi-rigid, resilient material may be made of any material that is both flexible and rigid. For example, in some embodiments the resilient material may be made of a solid plastic or plastic mesh. In many embodiments, these strips (42) of rigid or semi-rigid, resilient material (40) are configured to further define the tool holding sections (44) and to provide further rigidity along the non-flexible axis (32) such that the folding of the tool holder anywhere except along the set of predefined folding sections (34) in the predetermined configuration is substantially prevented.

Figure 3:
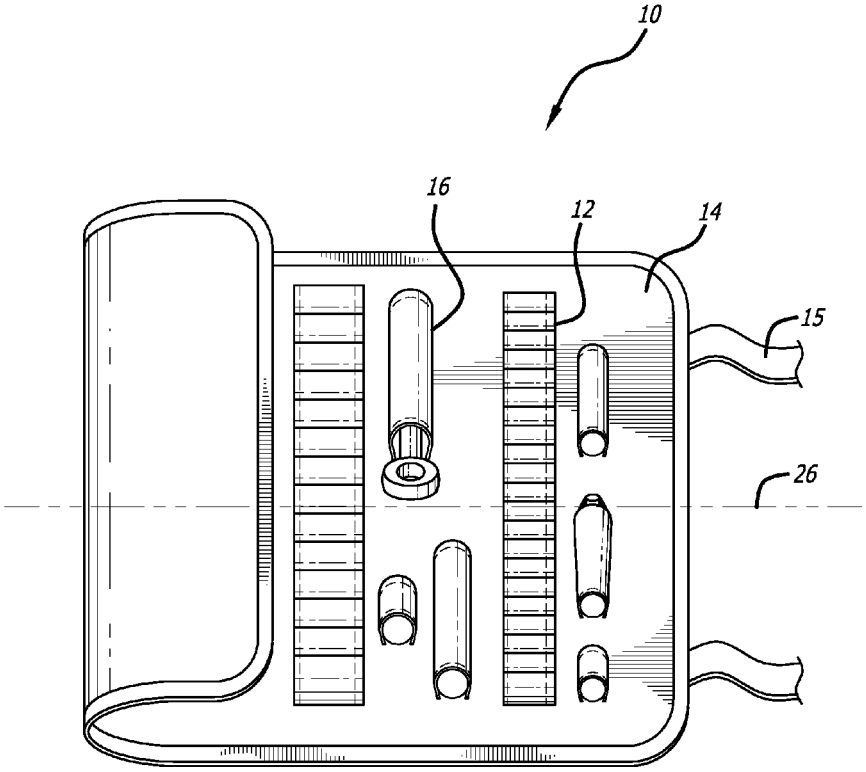
FIGS. 3 and 4 illustrate a perspective view of a tool holder in a partially rolled state in accordance with embodiments of the invention.
Figure 4:
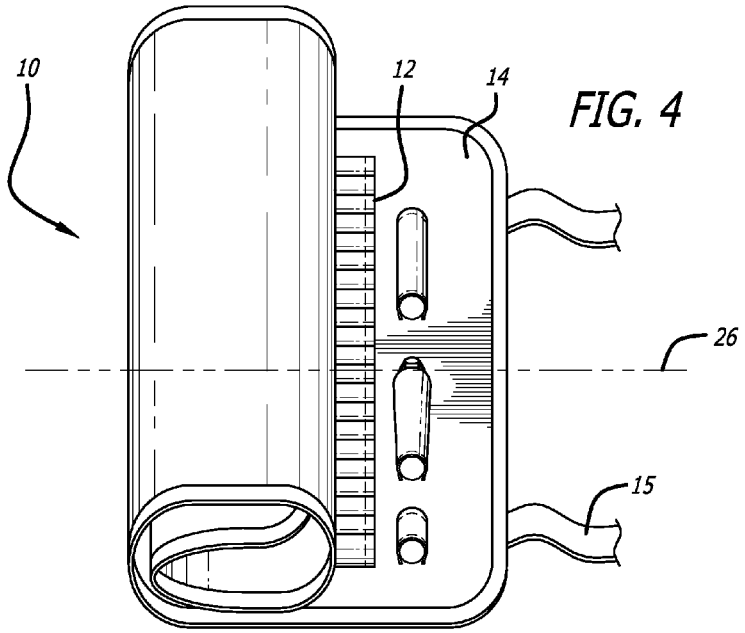
Figure 5:
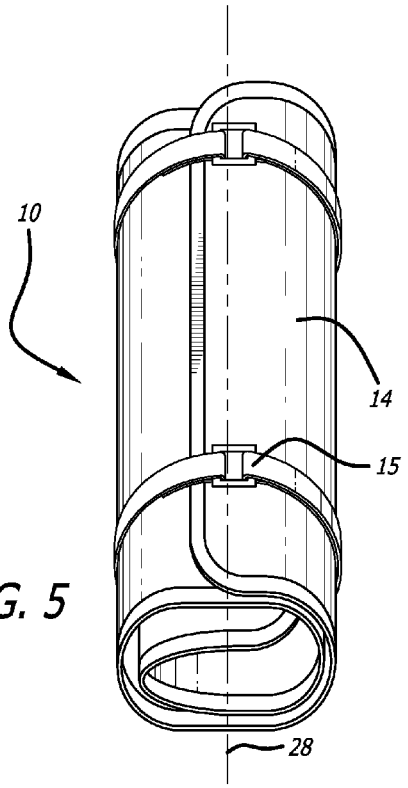
FIG. 5 illustrates an end view of a tool holder in a rolled up state in accordance with embodiments of the invention.

Embodiments of such a tool holder in partially rolled and in its compacted, or rolled stated, are shown in FIGS. 3 to 5. As shown, the compacting or folding of the flexible tool holder occurs in sections defined along the rigid axis (26) in the direction of the compacting axis (28). In many embodiments the folding corresponds with the sections (22) and/or (44) described above in relation to FIGS. 1 and/or 2B. Although one embodiment of a flexible tool holder is shown collectively in FIGS. 3 to 5, it should be understood that other embodiments having different predetermined foldable configurations might be provided. For example, the tool holding portions could be grouped into square or triangular semi-rigid sections with flexible portions of material there-between such that the tool holder could be folded along multiple axes, such as in a square, rectangular or diagonal predetermined configuration. In the embodiment shown in FIGS. 3 to 5 it is also shown that in the fully compacted or rolled configuration (FIG. 5) securing straps (15) may be engaged to secure the flexible tool holder in the compacted configuration.

As shown in FIGS. 3 to 5, the tool holding portions (12) may be spaced apart from the edge of the flexible material (14), such that there is a gap between the end of the tool holding portions and the flexible material. In such embodiments, when the flexible tool holder is in its compact rolled form, as shown in FIG. 5, this gap provides a buffer of flexible material at the edges of the tool holder (10) at either end of the rigid axis (26) such that the tools contained therein are protected from shock or damage along the open rolled end of the flexible tool holder.

Although not described above, it should be understood that accessories may be provided on the outer surface of the flexible material (14) of the tool holder (10) to provide further convenience, including, for example, carrying handles (17), pockets, tags, etc. An embodiment with a carrying handle (17) is shown schematically in FIG. 6.

Figure 8:
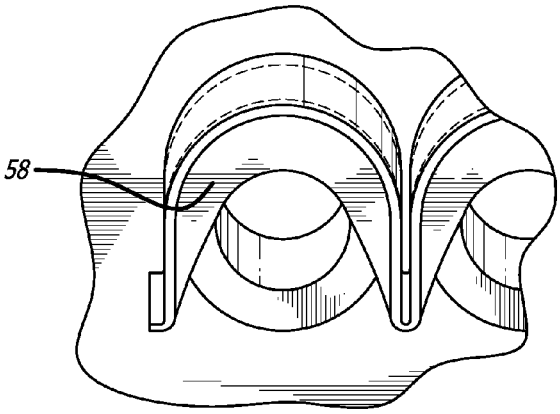
FIG. 8 illustrates a close-up view of an individual socket holder of a tool holder in accordance with embodiments of the invention.
Figure 9:
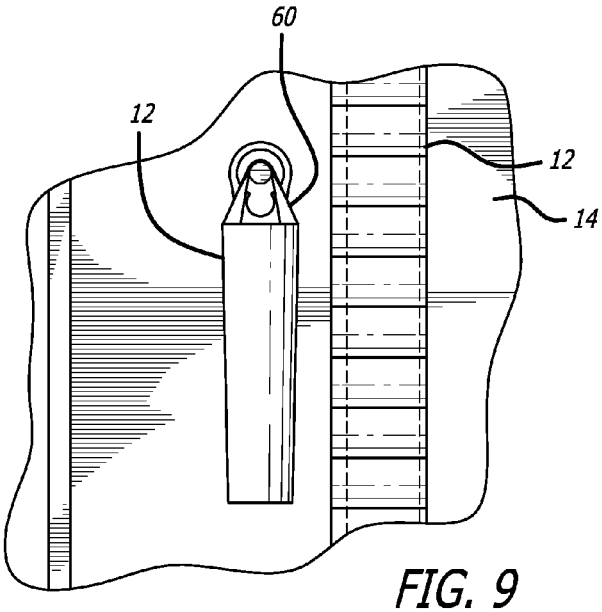
FIG. 9 illustrates a close-up view of an individual wrench holder of a tool holder in accordance with embodiments of the invention.
Figure 10:
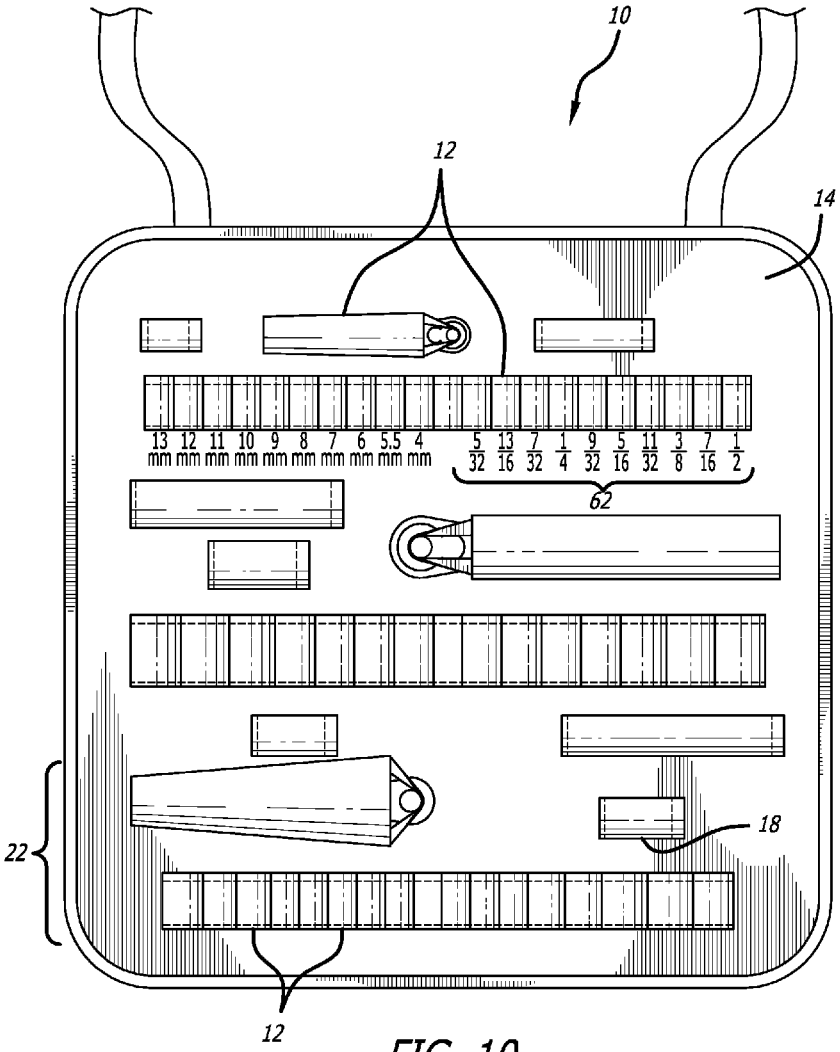
FIG. 10 illustrates a perspective view of a tool holder in an unrolled state in accordance with embodiments of the invention.

Turning to the tool holding portions, as shown in FIGS. 1, 8 and 9 the tool holding portions may take any suitable shape, size, and configuration required to be cooperative with the tool to be contained therein. Regardless of the particular size and configuration, the tool holding portions may comprise a loop, strap, pocket or other fasteners. In some embodiments, such as that shown in FIG. 9, where a portion of the tool to be held by the tool holding portion extends outside the tool holding portion (12), a separate fastener (60) may also be included to secure the tool. Exemplary fasteners may include, for example, elastic bands, straps, snaps, zippers, etc. The tool holding portions may be formed of any suitable material, such as for example, woven cloth, plastics, metal foils, etc. In some embodiments, the tool holding portion is sized to be slightly smaller than the tool to be contained therein and the material of the tool holding portion is stretchable and resilient such that it can expand and contract to better conform the shape and size of the tool being inserted therein.

Figure 7:
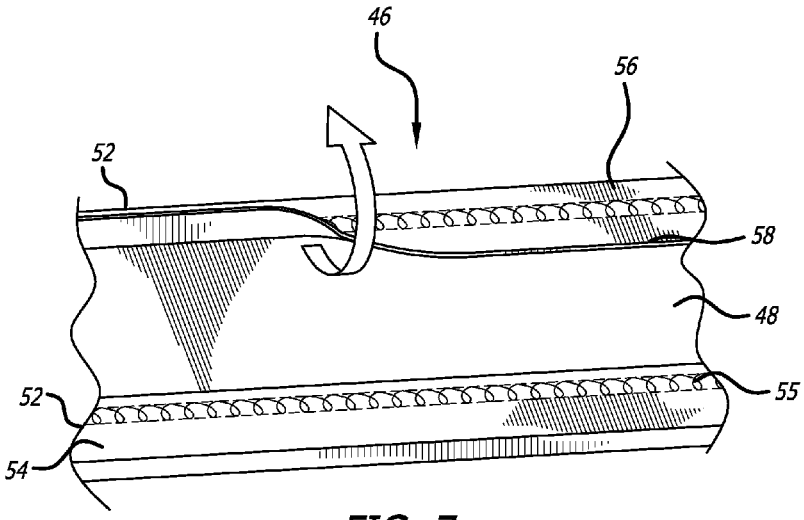
FIG. 7 illustrates a close-up view of the inner construction of an individual socket holder of a tool holder in accordance with embodiments of the invention.

As shown in FIGS. 7 and 8, in many embodiments where the tool holding portions are designed for containing interchangeable sockets they may be formed as loops of a material, the loops having openings at either end such that the interchangeable sockets may be inserted into either end of the loop of the tool holding portion. FIG. 7 provides a view of the inner construction of some embodiments of a tool holding portion (46) designed specifically to hold interchangeable sockets. As shown, in this embodiment the tool holding portion (46) comprises a fabric strap (48), (that may be made of one or more suitable materials, but in many embodiments has at least one material having elastomeric properties) the ends of which are attached to the flexible body material such that the strap is formed into a looped tool holding portion having loop openings specifically configured and sized for a particular interchangeable socket. In many embodiments the fabric strap has lateral edges (52) that when configured into a tool holding portion will form the loop openings in the tool holding portion. As shown in FIG. 7, in some embodiments one of the lateral edges (54) is secured (such as by stitching) at the end of the cloth such that the edge of the cloth (55) is securely anchored against the strap along its entire length, while a second of the lateral edges (56) is secured (such as by stitching) at a point along its length such that a resilient flap of cloth (58) is formed along the terminal end of the lateral edge.

During operation, this construction allows for the interchangeable socket to be insert in either end of the tool holding portion, but once inserted, the flap along the second lateral edge serves as a securing portion or lip (58) that is configured to partially occlude the opening and catch the tool when an attempt is made to pass the interchangeable socket in the direction of the edge flap, i.e., past the securing portion (58), thus preventing the interchangeable socket from being removed in that direct. Using such a construction it is possible to form a tool holding portion into which a socket tool may be inserted bi-directionally, but which can only be removed in a single direction, thus increasing both the flexibility and security of the tool holder.

Although embodiments are shown in FIGS. 7 and 8 in which a separate piece of material is used to form the securing portion, it should be understood that in other embodiments the lateral edges (52) of the fabric strap may themselves be folded over and stitched as shown in FIG. 7 to form the securing portion described. Regardless of the specific design of the securing portion the additional material also adds to the security of the tools by preventing wear between the tools.

Figure 6:
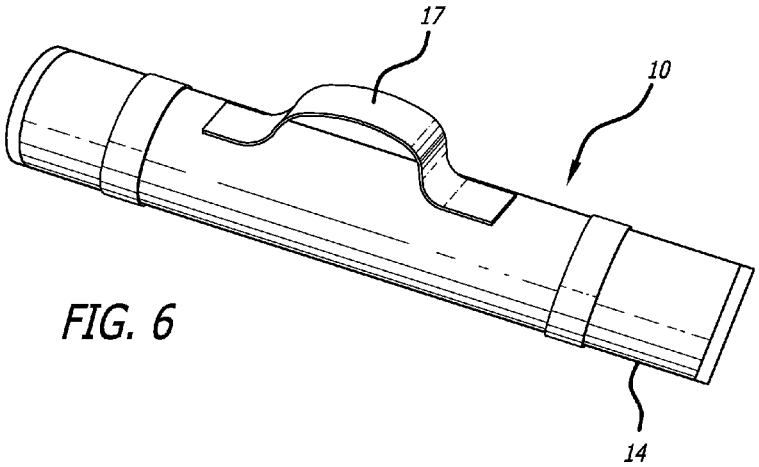
FIG. 6 illustrates a perspective view of a tool holder in a rolled up state in accordance with embodiments of the invention.

Finally, although specific embodiments of a flexible tool holder are formed it will be understood that other elements may be included into such a holder without altering its overall functions. For example, additional straps, buckles, fasteners or other hardware may be included to secure the tool holder in its compacted form as shown in FIG. 5, for example. Likewise, straps or handles may also be integrated into the tool holder to allow for more convenient carrying and transport of the tool holder, as shown in FIG. 6. These straps and handles may include other fasteners, such as buckles, snaps, hook & loop, buttons, zippers, etc. In addition, it should be understood that the edges or outer surface of the tool holder in its compacted form may be formed of reinforced materials capable of withstanding greater wear and stress than the body of the flexible material. In addition, organizing information and labels (62) may be included on the inner surface of the flexible material (14) of the flexible tool holder (10) to identify the proper tool holder (12) for a specific tool, such as, for example, socket sizes for specific interchangeable sockets.

Although the above disclosure provides figures and schematics for tool holders capable, in certain embodiments, of providing storage for a full complement of sockets and socket wrenches, it should be understood that versions of the tool holder configured to provide storage for a smaller set of sockets and socket wrenches, such as sockets for a particular sized drive (e.g., ½, ¼, etc.) may also be provided. Further, although the above discussion has focused on a flexible tool holder with respect to socket wrenches and socket wrench accessories, it should be understood that similar principles, methods of construction and features may be used and adapted to construct flexible tool holders for many small hand tools, such as, for example, screw drivers, hex wrenches, crescent wrenches, bicycle tools, wood working tools, etc.

DOCTRINE OF EQUIVALENTS

As can be inferred from the above discussion, the above-mentioned concepts can be implemented in a variety of arrangements in accordance with embodiments of the invention. Accordingly, although the present invention has been described in certain specific aspects, many additional modifications and variations would be apparent to those skilled in the art. It is therefore to be understood that the present invention may be practiced otherwise than specifically described. Thus, embodiments of the present invention should be considered in all respects as illustrative and not restrictive.

What claimed is:

1. A flexible tool holder comprising:

a flexible body having inner and outer surfaces and defining at least a first rigid axis and at least a second compacting axis;

a plurality of tool holders disposed on the inner surface of the flexible body, the plurality of tool holders being arranged within at least two discrete sections along the first rigid axis, each of the at least two discrete sections being separated by at least one flexible section therebetween having no tool holders disposed thereon, and defined by a separate section of a semi-rigid material disposed between the inner and outer surfaces of the flexible body, each of the sections of semi-rigid material being arranged to resist folding of the flexible body along the first rigid axis along which the respective discrete section is disposed;

wherein the tool holder is foldable along the second compacting axis in a predetermined compact configuration determined by the disposition of the at least two discrete sections of tool;

wherein the plurality of tool holders include at least one interchangeable socket holder strap having first and second ends interconnected with the inner surface of the flexible body and forming a loop defining a cylindrical axis and having first and second loop openings disposed opposite each other in-line with the cylindrical axis, and wherein the loop and both loop openings are dimensioned such that an interchangeable socket comprising a cylindrical body having first and second edges may be slidingly introduced through either the first or second loop openings and held within said loop; and wherein the first loop opening further comprises a flexible securing portion disposed along at least a portion of the lateral edge thereof and configured to engage and secure at least an edge of the interchangeable socket when the interchangeable socket is moved from within the loop along the cylindrical axis toward said first loop opening.

2. The flexible tool holder of claim 1, wherein the tool holder comprises at least three discrete sections of the plurality of tool holders each having at least one section of flexible material disposed therebetween.

3. The flexible tool holder of claim 1, wherein the each of the discrete sections is defined by a separate section of a semi-rigid material disposed between the inner and outer surfaces of the flexible body, each of the sections of semi-rigid material being arranged to resist folding of the flexible body along the first rigid axis along which the respective discrete section is disposed.

4. The flexible tool holder of claim 3, wherein the semi-rigid material is formed of a resilient plastic material.

5. The flexible tool holder of claim 2, wherein the discrete sections and flexible sections are arranged such that the tool holder is compacted by folding adjacent discrete sections atop each other along the second compacting axis.

6. The flexible tool holder of claim 1, further comprising at least one strap disposed on the outer surface of the flexible body and arranged to releasable secure the tool holder in the predetermined compact configuration.

7. The flexible tool holder of claim 1, further comprising at least one carrying handle disposed on the outer surface of the flexible body.

8. The flexible tool holder of claim 1, wherein the plurality of tool holders are selected to secure tools selected from the group consisting of interchangeable sockets, socket wrenches, socket adapters, and ratchet tools.

9. The flexible tool holder of claim 1, wherein the flexible body is formed from a flexible material selected from the group consisting of woven fabrics, polymers, and plastics.

10. The flexible tool holder of claim 1, further comprising a backing material disposed between the inner and outer surfaces of the flexible body, the backing material selected from the group consisting of woven materials, plastics, rubbers, padding and bunting.

11. The flexible tool holder of claim 1, wherein the securing portion comprises a strip of material having first and second strip edges and being disposed along at least a portion of the circumference of the first loop opening, wherein the first strip edge is disposed proximal the lateral edge of the first loop opening and securely attached to said interchangeable socket strap, and wherein the second strip edge is disposed within the loop distal the first loop opening, and wherein the second strip edge is unattached to the socket holder strap such that a movable flap of material is formed between the second and a first strip edges.

12. The flexible tool holder of claim 11, wherein the strip of material is further securely attached to the interchangeable socket strap along a line between said first and second strip edges.

13. The flexible tool holder of claim 11, wherein the securing portion is dimensioned to partially occlude the first loop opening when the unattached second strip edge is urged proximal the first loop opening.

14. The flexible tool holder of claim 1, wherein the at least one of either the interchangeable socket holder strap and the securing portion are formed of a resilient material.

15. The flexible tool holder of claim 1, wherein the plurality of tool holders are spaced apart from the edges of the flexible body such that a section of material having no tool holders is disposed around the outer perimeter of the inner surface of the flexible body.

16. The flexible tool holder of claim 1, further comprising tool fasteners disposed adjacent at least one of the plurality of tool holders and configured to securely restrain a tool within the at least one of the plurality of tool holders.

17. The flexible tool holder of claim 1, wherein the discrete and flexible sections are arranged such that the flexible body has multiple compacting axes.

18. The flexible tool holder of claim 1, wherein the plurality of tool holders are cooperatively arranged such that when the flexible body is compacted into predetermined compact configuration at least a portion of the plurality of tool holders of adjacent discrete sections are nonoverlapping.

19. The flexible tool holder of claim 1, further comprising tool labels disposed adjacent at least a portion of the plurality of tool holders and indicating at least the size of tool to be disposed therein.

* * * * *